US008256122B2

(12) United States Patent
Hatfield

(10) Patent No.: US 8,256,122 B2
(45) Date of Patent: Sep. 4, 2012

(54) MAGNETIC TWO PART SCRAPING TOOL

(76) Inventor: John T. Hatfield, Cross Lanes, WV (US)

( * ) Notice: Subject to any disclaimer, the term of this patent is extended or adjusted under 35 U.S.C. 154(b) by 458 days.

(21) Appl. No.: 12/505,466

(22) Filed: Jul. 18, 2009

(65) Prior Publication Data

US 2011/0010948 A1 Jan. 20, 2011

(51) Int. Cl.
*B26B 3/00* (2006.01)

(52) U.S. Cl. ..... 30/172; 15/220.2

(58) Field of Classification Search ..... 30/172; 15/220.2, 245, 220, 105, 104; 119/264; 134/6, 134/8, 22.1, 42
See application file for complete search history.

(56) References Cited

U.S. PATENT DOCUMENTS

| | | | | |
|---|---|---|---|---|
| 2,507,559 | A | 5/1950 | D'Andrea | |
| 2,634,444 | A | 4/1953 | Coleman | |
| 3,208,090 | A | 9/1965 | Roesel, Jr. | |
| 3,296,645 | A | 1/1967 | Shore | |
| 3,492,685 | A | 2/1970 | Curzon | |
| 3,600,737 | A * | 8/1971 | Shore | 15/104.001 |
| 4,574,417 | A * | 3/1986 | Magnasco | 15/236.05 |
| 4,977,637 | A | 12/1990 | Demers | |
| 5,515,570 | A | 5/1996 | Muscroft | |
| 5,660,632 | A * | 8/1997 | Volpe et al. | 118/213 |
| 5,988,109 | A | 11/1999 | Rofen | |
| 6,206,978 | B1 | 3/2001 | Tsui | |
| 6,348,104 | B1 * | 2/2002 | Bakker | 134/6 |
| 6,634,052 | B2 | 10/2003 | Hanson | |
| 6,865,771 | B2 | 3/2005 | Hanson | |
| 2006/0090278 | A1 * | 5/2006 | Hang | 15/220.2 |

FOREIGN PATENT DOCUMENTS

| | | | |
|---|---|---|---|
| GB | 2105977 | A | 4/1983 |
| WO | WO0040080 | A1 | 7/2000 |

* cited by examiner

*Primary Examiner* — Ghassem Alie
(74) *Attorney, Agent, or Firm* — Christopher Wood; Premier Law Group, PLLC

(57) ABSTRACT

A two part scraper for scraping glass and other substrates, wherein a scraping part may be located on one side of the substrate and a handle member may be located on the other side. The two parts are magnetically coupled and move in tandem when the handle part is pulled by the user. A cutting blade may be received within a blade holder which may be mounted to the scraping part by screws and coil springs. The blade holder may be mounted at an angle such as a forty-five degree angle to the surface being scraped. The scraping part may comprise hook and loop material as a scrubbing surface and may have a suction cup located on that surface contacting the substrate. The handle part may have a soft felt lining for contacting the substrate.

20 Claims, 6 Drawing Sheets

| TABLE 1 | |
|---|---|
| | |
| PART # | DESCRIPTION |
| 100 | Two part tool |
| 120 | Scraping member |
| 140 | Handle member |
| 160 | Handle body |
| 180 | Magnet |
| 200 | Steel plate of scraping member 120 |
| 220 | Steel plate of handle member 140 |
| 240 | Openings in steel plate 200 |
| 260 | Scraping blade |
| 280 | Blade holder |
| 300 | Scraping body |
| 320 | Cleaning surface of scraping member 120 |
| 340 | Arrow indicating point of contact in Fig. 1 |
| 360 | Cutting edge of scraping blade 260 |
| 380 | Length of scraping body 300 |
| 400 | Width of scraping body 300 |
| 420 | Mounting body of scraping body 300 |
| 440 | Included angle in Fig. 4 |
| 460 | Screws |
| 480 | Coil springs |
| 500 | Enlarged heads of screws 460 |
| 520 | Screw holes formed in blade holder 280 |
| 540 | Screw holes formed in scraper body 300 |
| 560 | Mounting projection of scraper body 300 |
| 562 | Opening formed in blade holder 280 |
| 580 | Center line of blade holder 280 |
| 600 | Suction cup |
| 620 | Suction cup screw |
| 640 | Hook or loop members on scraping body 300 |
| 660 | Felt material o handle member 140 |
| 680 | Contact surface of handle member 140 |

Fig. 6

MAGNETIC TWO PART SCRAPING TOOL

FIELD OF THE INVENTION

The present invention pertains to cleaning tools, and more particularly to a tool for scraping interior surfaces of aquariums and like surfaces.

BACKGROUND OF THE INVENTION

Glass sheets are widely used for many applications, such as forming walls of aquariums, terrariums, and other receptacles, and windows of buildings, wheeled vehicles, and cabinets. Surfaces of such walls and windows may become fouled with objectionable substances and may require cleaning. If the sheet of glass is sufficiently large, scraping the glass with tool bearing an industrial sharp edged blade may become awkward or objectionable for various reasons.

In particular, algae constantly grows on aquarium walls despite frequent cleaning, and must be frequently removed. This is somewhat of a messy chore as the easiest way to scrape the wet surface of an aquarium wall is to reach into the aquarium with the hand. This may disrupt aspects of operation of the aquarium such as pump operation.

There exists a need for a scraping tool which can scrape the inside surfaces of aquarium walls and other smooth surfaces of thin substrates such as glass sheets typically employed to form aquarium walls, windows, and others.

SUMMARY OF THE INVENTION

The present invention provides a practical and effective tool which enables a user to move a scraping element along a thin substrate such as a glass sheet from the opposite side of the substrate. The novel scraper has a scraping part and a magnetically coupled handle part. A blade holder may be resiliently mounted on the scraping part. A blade is received by the blade holder and may be held there by screws and springs which collectively provide a yielding, spring urged mounting. The blade holder and blade may each be pre-existing commercial products intended for general purpose cutting.

The scraping part may have a suction cup to retain the former should its magnetic counterpart lose magnetic attraction. The scraping part may clean by scrubbing as well as by scraping with the blade. The bottom of the scraping part may be lined with hooks or loops of hook and loop material to provide a suitable scrubbing medium.

The handle part, which is drawn along the substrate by the user, may be lined with felt to protect delicate surfaces such as glass.

BRIEF DESCRIPTION OF THE DRAWINGS

Various features and attendant advantages of the present invention will become more fully appreciated as the same becomes better understood when considered in conjunction with the accompanying drawings, in which like reference characters designate the same or similar parts throughout the several views, and wherein:

FIG. 6 is a table of reference numerals identifying the components the reference numerals represent.

DETAILED DESCRIPTION OF THE INVENTION

Figure 1:
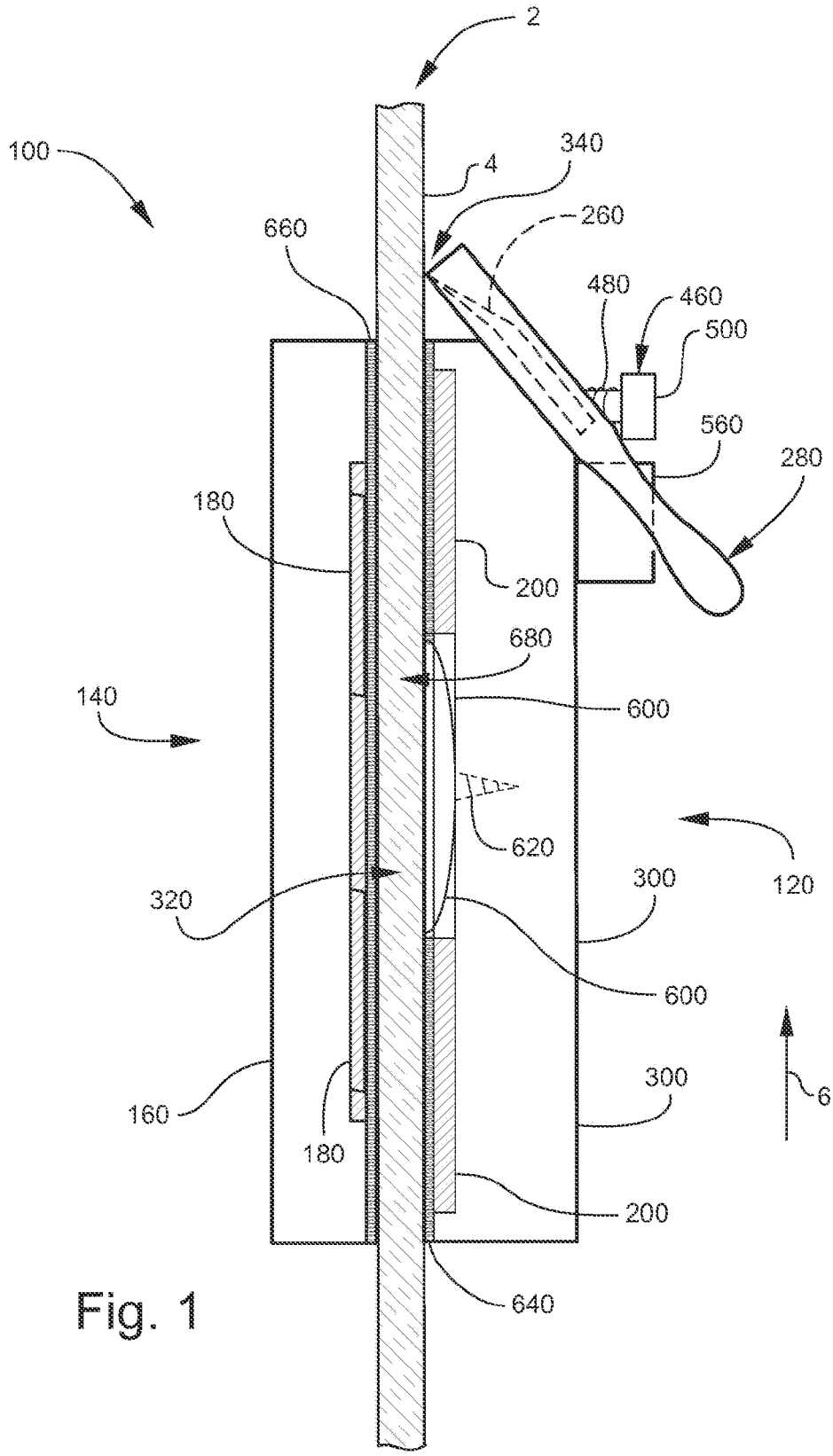
FIG. 1 is an environmental view of a two part scraping tool according to at least one aspect of the invention, rendered partly in cross section.

FIG. 1 of the drawings shows a two part scraping tool 100 for scraping a free standing substrate such as a glass pane 2. The glass pane 2 may be a wall of an aquarium or terrarium (neither shown), a wall or window of a cabinet (not shown), part of a window of a building or motor vehicle (not shown), or any other structure in which the glass pane 2 or other substrate is free standing. As employed herein, the term "free standing" will be understood to refer to a substrate which is accessible at both of two opposed sides or faces, so that the two part scraping tool 100 may be placed in sandwiching or straddling relationship thereto.

The two part scraping tool 100 comprises a scraping member 120 which slides along and scrapes the exposed surface 4 of the glass pane 2. The other part of the scraping tool 100 is a handle member 140 comprising a handle body 160 and a magnetically responsive member mounted thereto. The magnetically responsive member may comprise two permanent magnets 180. In use, a person grasps the handle member 140 and draws it along the glass pane 2 for example in the direction indicated by the arrow 6. The scraping member 120 follows or tracks the handle member 140 due to magnetic attraction.

To assure mutual magnetic attraction between the handle member 140 and the scraping member 120, the latter includes a magnetically responsive member such as a steel plate 200. At least one of the respective magnetically responsive members of the scraping member 120 and the handle member 140 must be a magnet such as the magnets 180. The other may merely respond to the magnetic field or alternatively, may also be a magnet. Magnets which would be suitable for use may be rare earth permanent magnets such as neodymium iron boride magnets.

Figure 2:
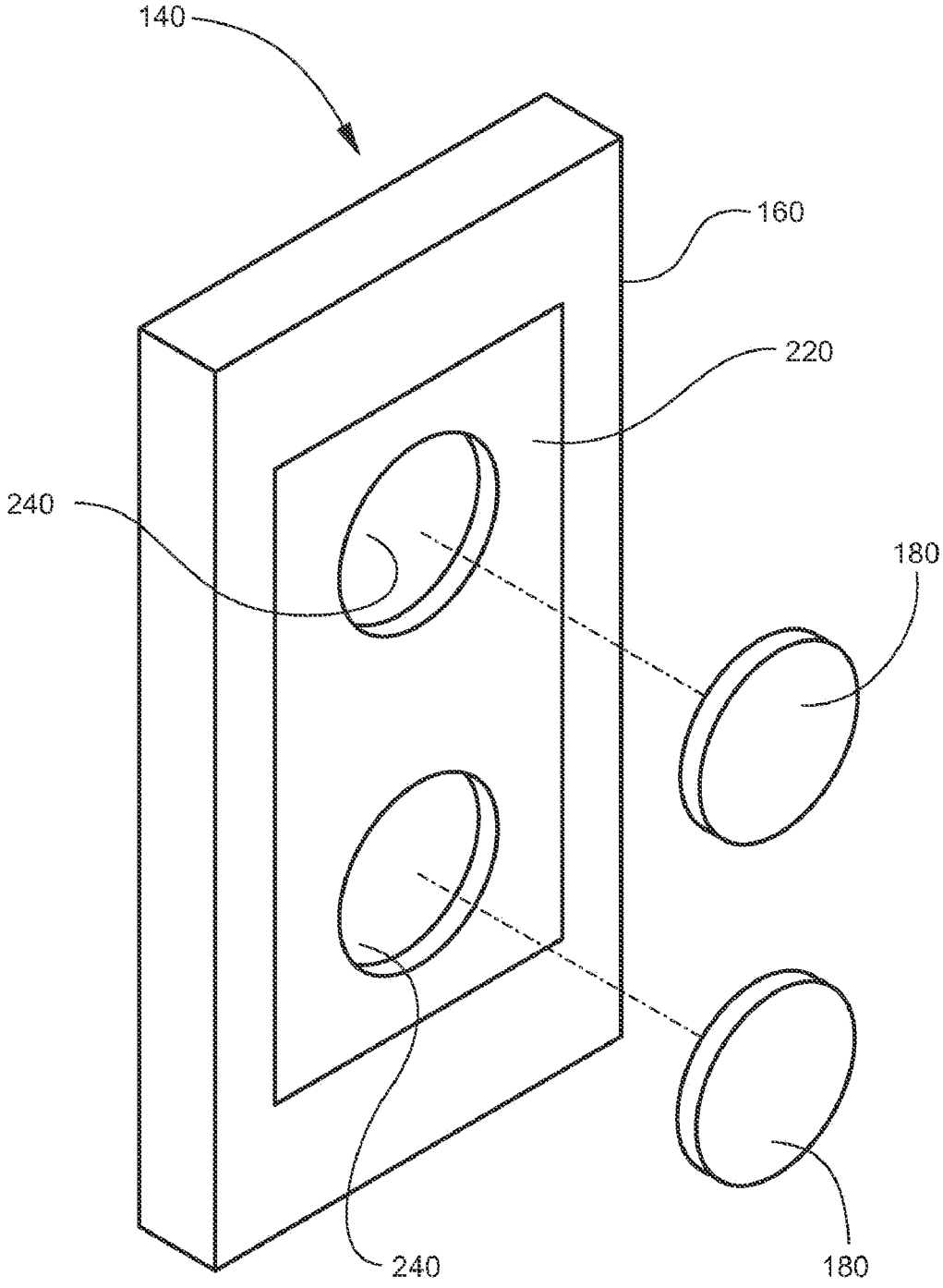
FIG. 2 is a perspective view of one of the two parts of the two part scraping tool of FIG. 1.

FIG. 2 shows an exemplary magnetic mounting of the magnets 180 within the handle member 140. The steel plate 220 may be embedded within, adhered to, or otherwise coupled to the handle body 160. The steel plate 220 may have openings 240 which correspond closely to the outer perimetric configuration of the magnets 180 so as to receive the latter within the former. Magnetic attraction and friction may retain the magnets 180 in place.

FIG. 1 illustrates placement of the scraping member 120 and the handle member 140 in a deployed position the scraping blade 260 is positioned on one side of the glass pane 2 in scraping relation thereto. The handle member 140 is placed on the opposed side of the glass pane 2 such that the magnetically responsive member of the scraping member 120 may magnetically attract and retain the magnetically responsive member of the handle member 140 and secure the former against the glass pane 2. In the deployed position, the scraping member 120 and the handle member 140 remain in mutual opposition and in mutual proximity even when the handle member 140 is pulled manually by the user along the glass pane 2.

The scraping member 120 may have a blade 260 mounted within a blade holder 280, which in turn is mounted to a scraping body 300. In the deployed position, and as shown in FIG. 1, the scraping body 300 comprises a cleaning surface 320, which is that surface which contacts the glass pane 2 in the deployed position.

It will be seen that the scraping blade 260 contacts the glass pane 2 at a location or point of contact indicated by arrow 340 which lies outside the bounds of the cleaning surface 320.

The scraping blade 260 has a cutting edge 360 (seen best in FIG. 3) which is disposed substantially along at least one side of the scraping blade 260. Alternatively stated, the cutting edge 360 has significant length, and for example does not comprise only a point (not shown). This characteristic assures that when the scraping member 120 is drawn along the glass pane 2, a significant swath of contact is established between the glass pane 2 and the cutting blade 260.

Given that the scraping body 300 and the handle body 160 may each have a length 380 of about three to three and one half inches and a width 400 of about two inches (dimensions for the scraping body 300 are called out in FIG. 3, but will be understood to apply also to the handle body 160), the swath of contact may be about one and one half to two and one half inches wide. The dimensions cited above are regarded as suitable for most tasks to which the two part scraping tool 100 may be applied, as with these dimensions, the handle member 140 is easily and effectively grasped in the hand of an adult user.

The dimensions regarding the swath of contact may be satisfied using a blade holder 280 which may be for example a commercially available general purpose blade holder available on the open market to the general public. Such blade holders may be sold for example as scraping tools intended to be held manually for tasks such as clearing windows of dirt, stickers, and the like. The blade holder 280 may be regarded therefore as a generally rigid device which is separate from its associated cutting body 300. Rigidity is sufficient to resist deformation under conditions of normal use, where deformation might expose other edges and corners of the scraping blade 260, cause loss of grasp of the scraping blade 260 by the blade holder 280, or otherwise interfere with successful scraping operations.

Such general purpose blade holders utilize commercially available general purpose cutting blades, which are also commercially available on the open market. Such general purpose blade holders enable relatively easy blade insertion, and afford cooperative reception and retention of cutting blades such as the cutting blade 280 in fixed relation thereto. Therefore, the novel two part cutting tool 100 may enjoy the advantages of readily available replacement parts, such as the cutting blade 260 and its associated blade holder 280, should replacement become necessary to wear, damage, fouling, loss, or any other reason.

Figure 3:
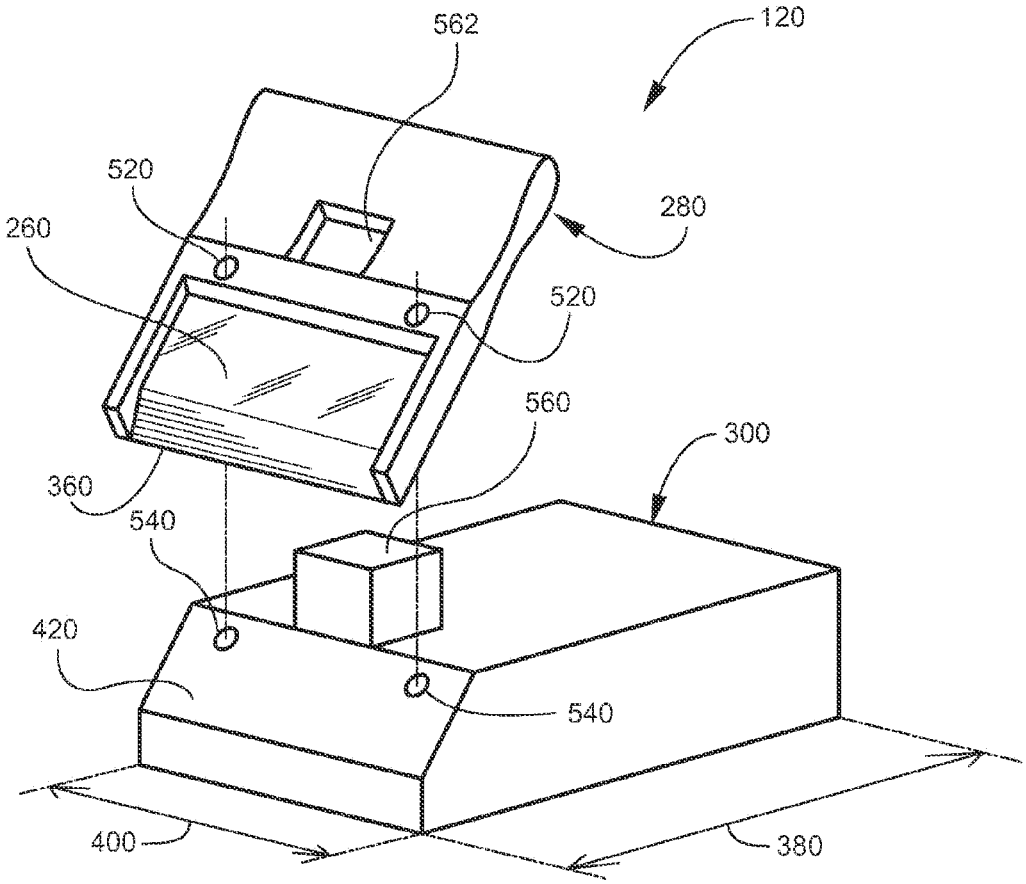
FIG. 3 is an exploded perspective view of the other of the two parts of the two part scraping tool of FIG. 1.
Figure 4:
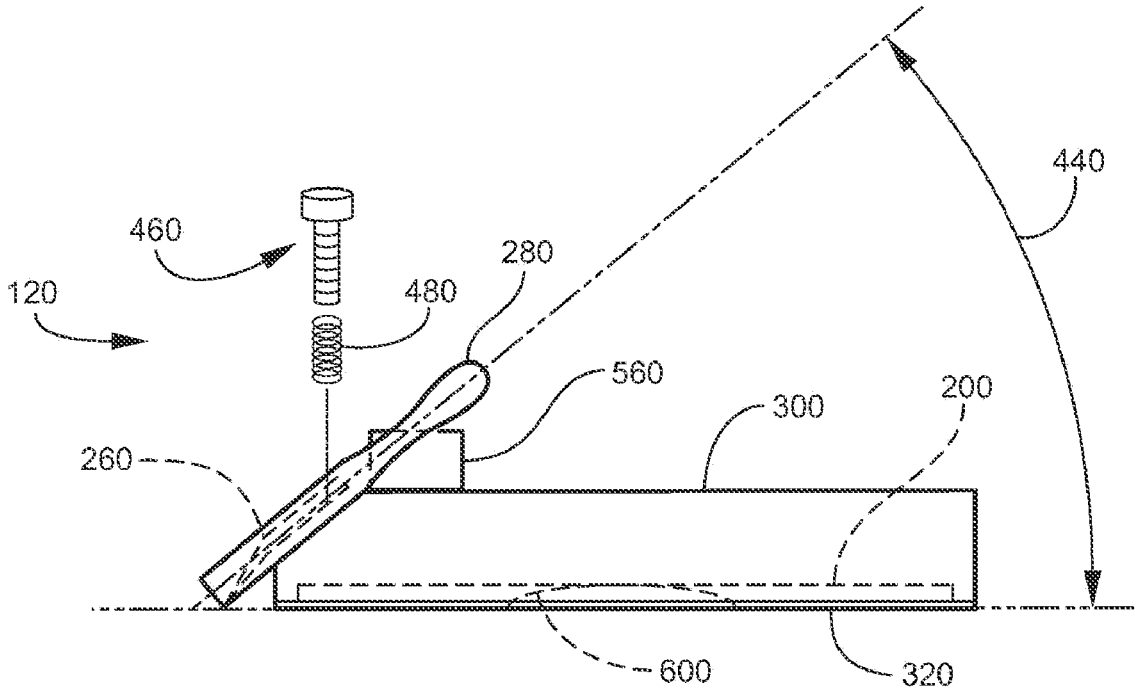
FIG. 4 is a partly exploded side elevational view of the part of FIG. 3.

The blade holder 280 may be mountable to the scraping body 300 in the following way. Referring also to FIG. 3, the scraping body 300 may have an externally exposed mounting surface 420 for receiving the generally rigid blade holder 280. The mounting surface 420 may be oriented at a non-perpendicular included angle 440 which may exist between the plane of the mounting surface 420 and the plane of the cleaning surface 320. The included angle 440 is shown in FIG. 4 as an arc spanning projection lines of the center plane of the blade holder 280 and of the cleaning surface 320. With the blade holder 280 mounted on the mounting surface 420, and in the deployed position shown in FIG. 1, the scraping blade 260 will be oriented along its length at the non-perpendicular angle relative to the exposed surface 4 of the glass pane 2.

The non-perpendicular angle may have a value within a range of about twenty degrees to about seventy degrees, and as depicted may be about forty-five degrees.

The blade holder 280 may be coupled to the scraping body 300 in any suitable way. As seen in FIG. 1, the blade holder 280 may be secured by a removable headed fastener such as bolts or screws 460 (both seen in FIG. 5). A coil spring 480 may be disposed between the enlarged head 500 of the screw 460 and the generally rigid blade holder 280. The coil spring 480 may be less than fully compressed when disposed between the enlarged head 500 and the blade holder 280, and has compressible play which enables the blade holder 280 to be resiliently urged against the scraping body 300.

As best seen in FIG. 3, each screw 460 is passed through and occupies a respective hole 520 formed in the blade holder 280 and then into a respective hole 540 formed in the scraping body 300. The holes 540 may be pre-threaded to accept the screw 460 or may be threaded by tapping action of the screw 460. The blade holder 280 may be oriented in appropriate position by a projection 560 formed in the scraping body 300, and is yieldingly or resiliently pinned in this position by the screws 460 and their associated coils springs 480. The generally rigid blade holder 280 may comprise an opening 562 which is dimensioned and configured to cooperate with the projection 560. This enables the generally rigid blade holder 280 to be located on the scraping body 300 prior to being fastened thereto by the screws 460 and the coil springs 480.

Figure 5:
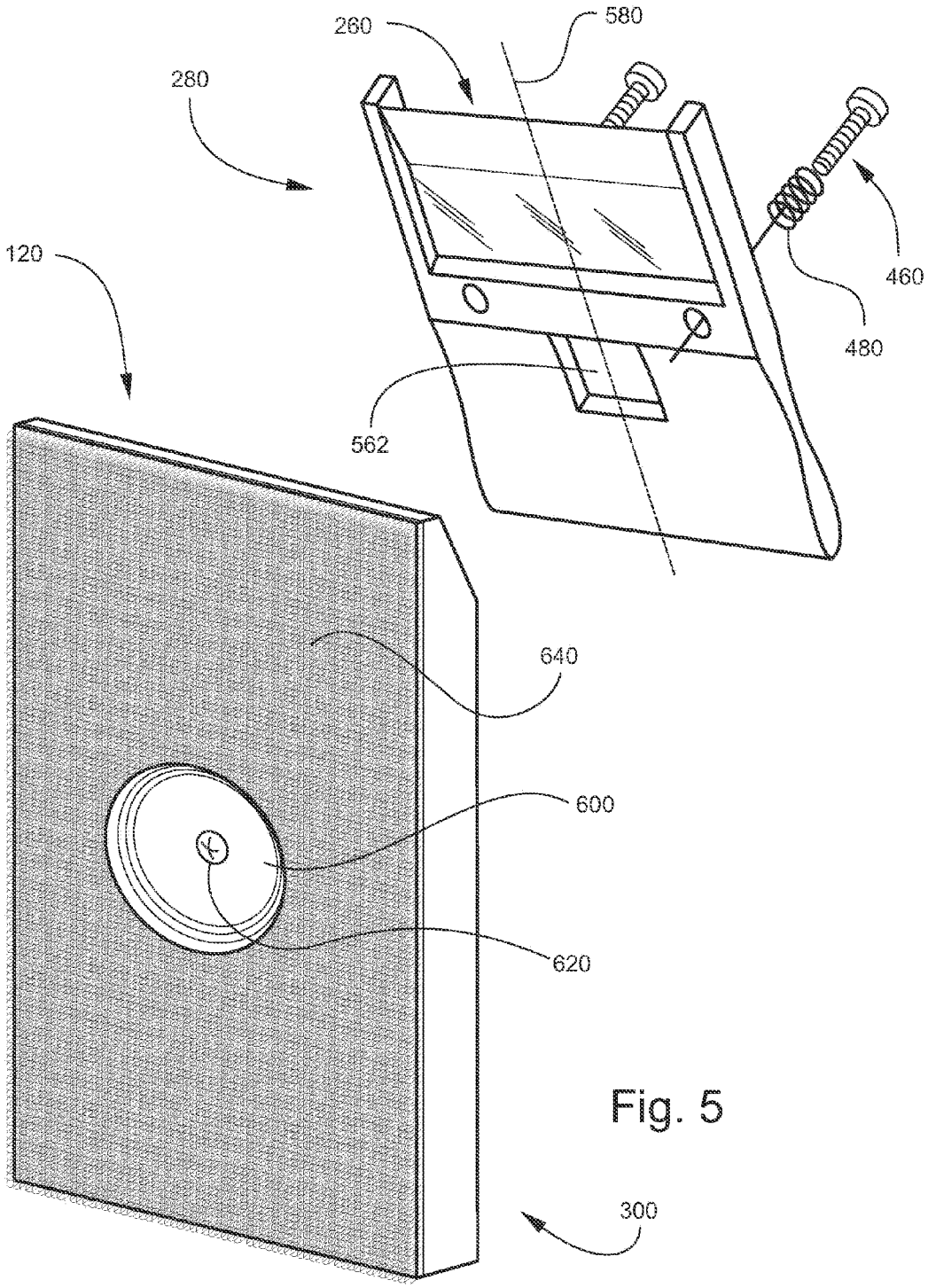
FIG. 5 is an exploded bottom perspective view of the part of FIG. 2.

Turning now to FIG. 5, the blade holder 280 will be seen to have a center line 580 which is parallel to the direction of motion of the scraping body 300 when the scraping body 300 is being moved along the glass pane 2 in the direction of the arrow 6. The holes 540 are each disposed on one side of the center line 580 in mirror image symmetric relation to one another. This arrangement stably holds the blade holder 280 to the scraper body 300, for example by tending to resist cocking or inclining of the blade holder 280 should asymmetric resistance due to fouling being removed by scraping at the surface 4 be encountered.

Also shown in FIG. 5 is a suction cup 600 which may bear against the glass pane 2 with the scraping member 120 in the deployed position to hold the scraping member 120 to the glass pane 2 should magnetic attraction of the scraping member to the handle member 140 be broken. This prevents the scraping member from falling from the glass pane 2. The suction cup 600 may be secured to the scraping body by a screw 620.

The cleaning surface 320 of the scraping body 300 may be lined with or otherwise comprise one of the hook members and the loop members (shown representatively as 640) of hook and loop fastening material. This enables the scraping member 120 to clean by both scraping action of the scraping blade 260 and also by scrubbing action of the hook or loop members 640. Because the hook and loop members 640 are made from a yielding material such as nylon, the hook and loop members 640 also resist scratching of the glass pane 2 as scraping and scrubbing proceed.

A corresponding protection is provided to the other side of the glass pane by a soft material such as felt 660 (see FIG. 1) which may be disposed on the contact surface 680 of the handle member 140. The contact surface 680 is that surface which contacts the glass pane 2 when the handle member is in the deployed condition, and which corresponds to the cleaning surface 320 of the scraping member 120.

It would be possible to modify the two part scraping tool to accommodate direct mounting of the scraping blade within the scraping body, rather than using the generally rigid blade holder.

FIG. 6 is a table of reference numerals identifying the components the reference numerals represent.

Although description of the novel tool has referred to use with aquariums, it will be appreciated that cleaning, scraping and other tasks described herein may also be performed with respect to terrariums, windows, cabinets, and other objects which have glass or other smooth surfaces.

TABLE 1

| PART # | DESCRIPTION |
|---|---|
| 100 | Two part tool |
| 120 | Scraping member |
| 140 | Handle member |
| 160 | Handle body |
| 180 | Magnet |
| 200 | Steel plate of scraping member 120 |
| 220 | Steel plate of handle member 140 |
| 240 | Openings in steel plate 200 |
| 260 | Scraping blade |
| 280 | Blade holder |
| 300 | Scraping body |
| 320 | Cleaning surface of scraping member 120 |
| 340 | Arrow indicating point of contact in FIG. 1 |
| 360 | Cutting edge of scraping blade 260 |
| 380 | Length of scraping body 300 |
| 400 | Width of scraping body 300 |
| 420 | Mounting body of scraping body 300 |
| 440 | Included angle in FIG. 4 |
| 460 | Screws |
| 480 | Coil springs |
| 500 | Enlarged heads of screws 460 |
| 520 | Screw holes formed in blade holder 280 |
| 540 | Screw holes formed in scraper body 300 |
| 560 | Mounting projection of scraper body 300 |
| 562 | Opening formed in blade holder 280 |
| 580 | Center line of blade holder 280 |
| 600 | Suction cup |
| 620 | Suction cup screw |
| 640 | Hook or loop members on scraping body 300 |
| 660 | Felt material o handle member 140 |
| 680 | Contact surface of handle member 140 |

I claim:

1. A two part scraping tool for scraping a free standing substrate by sandwiching the free standing substrate between the two parts of the scraping tool such that one of the two parts slides along and scrapes an exposed surface of the free standing substrate, the two part scraping tool comprising:

a scraping member for sliding along and scraping the exposed surface of the free standing substrate, comprising a scraping body further comprising a scraping blade having a cutting edge disposed substantially along at least one side of said scraping blade, a separate generally rigid blade holder which is disposed to cooperatively receive and retain said scraping blade in fixed relation thereto, and which said generally rigid blade holder is mountable to said scraping body, a removable fastener disposed to couple said generally rigid blade holder to said scraping body; and a first magnetically responsive member mounted to said scraping body; and a handle member comprising a handle body and a second magnetically responsive member mounted to said handle body; wherein when said handle member and said scraping member are placed in a deployed position said scraping blade is positioned on one side of the free standing substrate in scraping relation to the free standing substrate, and said handle member is placed on the opposed side of the free standing substrate such that said first magnetically responsive member magnetically attracts and retains said second magnetically responsive member against the free standing substrate with said handle member and said scraping member remaining in mutual opposition and in mutual proximity even when said handle member is pulled along the free standing substrate, wherein at least one of said first magnetically responsive member and said second magnetically responsive member comprises a permanent magnet, wherein said scrapping member includes a steel plate, and said handle member includes a steel plate, wherein said steel plates of the scrapping member and handle member ensure mutual magnetic attraction between the handle member and the scrapping member.

2. The two part scraping tool according to claim 1, wherein said fastener comprises an enlarged head and a spring disposed between said enlarged head and said generally rigid blade holder, said spring is less than fully compressed when disposed between said enlarged head and said blade holder, and has compressible play which enables said generally rigid blade holder to be resiliently urged against said scraping body.

3. The two part scraping tool according to claim 1, wherein said scraping body comprises a projection, and said generally rigid blade holder comprises an opening which is dimensioned and configured to cooperate with said projection, whereby said generally rigid blade holder is located on said scraping body prior to being fastened thereto by said fastener.

4. The two part scraping tool according to claim 1, wherein said generally rigid blade holder comprises a commercially available general purpose blade holder.

5. The two part scraping tool according to claim 1, wherein said generally rigid blade holder comprises at least two holes disposed thereon, and said fastener comprises at least two fasteners, and each one of said fasteners occupies one of said at least two holes.

6. The two part scraping tool according to claim 5, wherein said blade holder comprises a center line which is parallel to the direction of motion of said scraping body when said scraping body is being moved along the free standing substrate, said blade holder comprises a first hole and a second hole said first hole is disposed on one side of said center line, and said second hole is disposed on the other side of said center line in mirror image symmetric relation to said first said hole.

7. The two part scraping tool according to claim 1, wherein said scraping body comprises:

a cleaning surface which contacts the surface of the free standing substrate when said scraping body is in said deployed position, and an externally exposed mounting surface for receiving said generally rigid blade holder, which said mounting surface is oriented at a non-perpendicular included angle, whereby when said scraping body is in the deployed position and said generally rigid blade holder is mounted on said mounting surface, said scraping blade is oriented along its length at said non-perpendicular angle relative to the free standing substrate.

8. The two part scraping tool according to claim 7, wherein said non-perpendicular included angle is within a range of about twenty degrees to about seventy degrees.

9. The two part scraping tool according to claim 7, wherein said non-perpendicular included angle is about forty-five degrees.

10. The two part scraping tool according to claim 1, wherein said scraping body comprises a cleaning surface which contacts the free standing substrate in said deployed position, and said scraping member further comprises a suction cup which bears against the free standing substrate when said scraping member is in said deployed position.

11. The two part scraping tool according to claim 7, wherein said cleaning surface of said scraping member comprises one of the hook members and the loop members of hook and loop fastening material.

12. The two part scraping tool according to claim 1, wherein said scraping blade comprises a commercially available general purpose cutting blade.

13. The two part scraping tool according to claim 1, wherein said handle member comprises a contact surface which contacts the free standing substrate when said handle member is in said deployed position, and wherein said contact surface of said handle member comprises soft felt material.

14. The two part scraping tool according to claim 1, wherein said handle member has a length of about three to three and one half inches and a width of about two inches, whereby said handle member is easily and effectively grasped in the hand of an adult user.

15. The two part scraping tool according to claim 1, wherein said scraping body comprises a cleaning surface which contacts the free standing substrate in said deployed position, and said cutting edge of said scraping blade contacts the free standing substrate at a location outside the bounds of said cleaning surface of said scraping body.

16. The two part scraping tool according to claim 1, wherein said second magnetically responsive member comprises at least one magnet, and said handle member comprises a magnetically responsive plate bearing an opening for receiving a said magnet.

17. A two part scraping tool for scraping a free standing substrate by sandwiching the free standing substrate between the two parts of the scraping tool such that one of the two parts slides along and scrapes an exposed surface of the free standing substrate, the two part scraping tool comprising:

a scraping member for sliding along and scraping the exposed surface of the free standing substrate, comprising a scraping body further comprising a scraping blade having a cutting edge disposed substantially along at least one side of said scraping blade, which said scraping blade is mountable on said scraping body, a fastener disposed to retain said scraping blade to said scraping member at a non-perpendicular included angle between the surface of the free standing substrate being scraped by said scraping tool and the length of said scraping blade, wherein said fastener is disposed to secure said blade to said scraping body, and a first magnetically responsive member mounted to said scraping body;

a handle member comprising a handle body and a second magnetically responsive member mounted to said handle body; wherein when said handle member and said scraping member are be placed in a deployed position wherein said scraping blade is positioned on one side of the free standing substrate in scraping relation to the free standing substrate, and said handle member is placed on the opposed side of the free standing substrate such that said first magnetically responsive member magnetically attracts and retains said second magnetically responsive member against the free standing substrate with said handle member and said scraping member remaining in mutual opposition and in mutual proximity even when said handle member is pulled along the free standing substrate, and at least one of said first magnetically responsive member and said second magnetically responsive member comprises a permanent magnet, wherein said scraping body comprises a suction cup which bears against the free standing substrate when said scraping member is in said deployed position, wherein said scrapping member includes a steel plate, and said handle member includes a steel plate, wherein said steel plates of the scrapping member and handle member ensure mutual magnetic attraction between the handle member and the scrapping member.

18. The two part scraping tool according to claim 17, wherein said handle member comprises a contact surface which contacts the free standing substrate when said handle member is in said deployed position, and wherein said contact surface of said handle member comprises soft felt material.

19. A two part scraping tool for scraping a free standing substrate by sandwiching the free standing substrate between the two parts of the scraping tool such that one of the two parts slides along and scrapes an exposed surface of the free standing substrate, the two part scraping tool comprising:

a scraping member for sliding along and scraping the exposed surface of the free standing substrate, comprising a scraping body further comprising a cleaning surface which contacts the free standing substrate in said deployed position, a scraping blade having a cutting edge disposed substantially along at least one side of said scraping blade, which said scraping blade is mountable on said scraping body, a fastener disposed to retain said scraping blade to said scraping member at a non-perpendicular included angle between the surface of the free standing substrate being scraped by said scraping tool and the length of said scraping blade, wherein said fastener is disposed to secure said blade to said scraping body, and a first magnetically responsive member mounted to said scraping body;

a handle member comprising a handle body and a second magnetically responsive member mounted to said handle body; wherein when said handle member and said scraping member are placed in a deployed position wherein said scraping blade is positioned on one side of the free standing substrate in scraping relation to the free standing substrate, and said handle member is placed on the opposed side of the free standing substrate such that said first magnetically responsive member magnetically attracts and retains said second magnetically responsive member against the free standing substrate with said handle member and said scraping member remaining in mutual opposition and in mutual proximity even when said handle member is pulled along the free standing substrate, and at least one of said first magnetically responsive member and said second magnetically responsive member comprises a permanent magnet, wherein said cleaning surface of said scraping member comprises one of the hook members and the loop members of hook and loop fastening material, whereby said two part scraping tool cleans both by scraping and by scrubbing, wherein said scrapping member includes a steel plate, and said handle member includes a steel plate, wherein said steel plates of the scrapping member and handle member ensure mutual magnetic attraction between the handle member and the scrapping member.

20. The two part scraping tool according to claim 19, wherein said handle member comprises a contact surface which contacts the free standing substrate when said handle member is in said deployed position, and wherein said contact surface of said handle member comprises soft felt material.

* * * * *